US007261148B2

(12) United States Patent
Rohrbaugh et al.

(10) Patent No.: US 7,261,148 B2
(45) Date of Patent: Aug. 28, 2007

(54) DIRECT EXPANSION COOLER HIGH VELOCITY DISHED HEAD

(75) Inventors: Daryl Eugene Rohrbaugh, Seven Valleys, PA (US); Joel I. Gordon, York, PA (US)

(73) Assignee: York International Corporation, York, PA (US)

( * ) Notice: Subject to any disclaimer, the term of this patent is extended or adjusted under 35 U.S.C. 154(b) by 49 days.

(21) Appl. No.: 11/140,774

(22) Filed: May 31, 2005

(65) Prior Publication Data

US 2006/0266504 A1 Nov. 30, 2006

(51) Int. Cl.
*F28F 9/02* (2006.01)

(52) U.S. Cl. ..... 165/158; 165/140

(58) Field of Classification Search ..... 165/158–161, 165/140

See application file for complete search history.

(56) References Cited

U.S. PATENT DOCUMENTS

| | | | | |
|---|---|---|---|---|
| 1,567,814 | A * | 12/1925 | Peebles | 165/158 |
| 1,862,310 | A | 6/1932 | How | |
| 2,158,842 | A | 5/1939 | Taddiken | |
| 2,213,410 | A * | 9/1940 | Rathbun | 165/76 |
| 2,223,320 | A | 11/1940 | Jacocks | |
| 2,596,195 | A | 5/1952 | Arbuckle | |
| 2,762,611 | A * | 9/1956 | Monroe et al. | 165/156 |
| 2,900,173 | A * | 8/1959 | Pickford | 165/161 |
| 3,321,013 | A | 5/1967 | Babylon | |
| 3,572,429 | A * | 3/1971 | Myers | 165/82 |
| 3,800,867 | A | 4/1974 | MacKenzie | |
| 4,105,065 | A * | 8/1978 | Chirico | 165/78 |
| 4,190,101 | A | 2/1980 | Hartmann | |
| 4,197,907 | A | 4/1980 | Smith | |
| 4,474,011 | A | 10/1984 | Nelson et al. | |
| 4,502,530 | A | 3/1985 | Huenniger | |
| H52 | H | 4/1986 | Brackenbury | |
| 4,635,707 | A * | 1/1987 | Gentry | 165/96 |
| 4,635,712 | A | 1/1987 | Baker et al. | |
| 4,805,694 | A | 2/1989 | Ayub | |
| 4,972,903 | A * | 11/1990 | Kwok | 165/158 |
| 5,117,903 | A | 6/1992 | Oshiyama et al. | |
| 6,206,086 | B1 | 3/2001 | McKey | |
| 6,736,199 | B2 | 5/2004 | Wanni et al. | |
| 2002/0040776 | A1 * | 4/2002 | Kokubunji et al. | 165/140 |
| 2003/0209344 | A1 * | 11/2003 | Fang et al. | 165/140 |
| 2005/0061025 | A1 * | 3/2005 | Ayub | 165/159 |

FOREIGN PATENT DOCUMENTS

| | | |
|---|---|---|
| JP | 55063395 A | 5/1980 |

* cited by examiner

*Primary Examiner*—Teresa J. Walberg
(74) *Attorney, Agent, or Firm*—McNees Wallace & Nurick LLC

(57) ABSTRACT

A dished head header assembly for a heat exchanger having a containment body that includes a rounded, or dished, wall portion forming an interior cavity. A flange attaches to the containment body and fastens the header assembly to the heat exchanger. A plurality of refrigerant passageways are extended through an opening in the containment body into the interior cavity. At least one baffle is attached to the rounded wall portion. The baffle divides the interior cavity into a plurality of sub-cavities. At least one divider divides the sub-cavities into a plurality of chambers. The plurality of passageways includes an inlet connection and an outlet connection for a plurality of refrigerant circuits. Each passageway is disposed in a corresponding chamber of the plurality of chambers. Extensions into the headers with diffusers insure efficient operation and performance of the heat exchanger. The adjustable flow restrictor plate maintains optimum velocities to further enhance performance.

16 Claims, 10 Drawing Sheets

DIRECT EXPANSION COOLER HIGH VELOCITY DISHED HEAD

FIELD OF THE INVENTION

The present invention is directed to shell and tube heat exchangers. In particular, the present invention is directed to headers for shell and tube heat exchangers used with heating ventilation and air conditioning (HVAC) systems.

BACKGROUND OF THE INVENTION

Shell and tube heat exchangers typically include headers on each end of the shell in order to provide access to the tubes within the shell for cleaning or service. The headers also provide containment for refrigerant or heat exchange fluid and provide the refrigerant or heat exchange fluid to the tubes. Chiller systems typically include a chiller heat exchanger, which is a shell and tube heat exchanger having a refrigerant flow in the tubes and heat exchange fluid, such as water, flowing in the shell. Each end of the chiller heat exchanger includes a header fastened to the shell. The header includes a flat head plate and a baffle chamber. The head plate is a flat, thick plate that provides containment of the refrigerant within the system. A gasket is placed between the head plate and the baffle chamber in order to reduce leakage. The baffle chamber contains one or more baffles to direct the flow of refrigerant into the tubes of the shell. The baffles also substantially prevent leakage between the inlet and outlet. A second gasket is placed between the baffle chamber and the shell in order to reduce leakage. Chiller systems may also include multiple refrigerant circuits having refrigerant loops that are independent of each other. In systems having multiple circuits, a divider between the circuits must also be included in the baffle chamber and independently attached. The divider requires bolts that fasten the divider to the end of the shell, adding to the complexity of installation, requiring additional gaskets, reducing the area available for tubes within the shell, and causing additional stress on the bolts fastening the header to the shell. These chiller heat exchangers have the additional drawback that multiple gaskets are required, thus increasing the occurrences of leakage of refrigerant and increasing the service costs. These chiller heat exchangers have the further drawback that the flat plate on the header is relatively thick and heavy, thereby increasing material cost and weight of the system. Additional bolts positioned at the center of the flat head, referred to as center bolts, are required on the flat heads to try to minimize deflection and avoid excessively thick heads. However, these center bolts are generally overstressed and result in additional leakage paths and cost.

Therefore, what is needed is a header assembly that contains refrigerant, requires simpler gasketing, weighs less, costs less, provides reduced stress for the fasteners attaching the head to the heat exchanger, provides high velocity refrigerant flow, and high efficiency operation, and eliminates the center bolts.

SUMMARY OF THE INVENTION

The present invention includes a dished-head header assembly for a heat exchanger having a containment body. The containment body includes a rounded, or dished, wall portion forming an interior cavity. A flange attaches to the containment body and fastens the header assembly to the heat exchanger. A plurality of refrigerant passageways are extended through an opening in the containment body into the interior cavity. At least one baffle is attached to the rounded wall portion. The baffle divides the interior cavity into a plurality of sub-cavities. At least one divider divides the sub-cavities into a plurality of chambers. The plurality of passageways includes an inlet connection and an outlet connection for a plurality of refrigerant circuits. Each passageway is disposed in a corresponding chamber of the plurality of chambers. Extensions into the headers with diffusers insure efficient operation and performance of the heat exchanger. The adjustable flow restrictor plate maintains optimum velocities to further enhance performance.

The present invention also includes another embodiment including a header assembly for attachment to a heat exchanger. The header assembly include a containment body having a rounded wall portion that forms an interior cavity. A flange portion is attached to the containment body and is configured to fasten the header assembly to the heat exchanger. At least one divider is attached to the containment body and is configured and disposed to divide the interior cavity into a plurality of chambers. A gasket is arranged and disposed to seal the chambers of the containment body against the heat exchanger to substantially prevent leaks of refrigerant to the atmosphere and between the plurality of chambers when the header assembly is attached to the heat exchanger. The plurality of chambers include a return chamber each corresponding to a refrigerant circuits.

The present invention also includes a heat exchanger, including chiller heat exchangers. The heater exchanger includes a shell for containing heat transfer fluid having a first end and a second end. A plurality of tubes for containing refrigerant are arranged and disposed within the shell. The plurality of tubes includes a first set of tubes and a second set of tubes. A first header assembly is detachably fastened to the first end and includes a first containment body. The first containment body includes a first rounded wall portion forming a first interior cavity. A flange attaches to the containment body and fastens the first header assembly to the shell. A plurality of refrigerant passageways are extended through an opening in the first containment body into the first interior cavity. At least one baffle is attached to the first rounded wall portion. The baffle divides the interior cavity into a plurality of sub-cavities. At least one first divider divides the sub-cavities into a plurality of chambers. The plurality of refrigerant passageways includes an inlet connection and an outlet connection for a plurality of refrigerant circuits. Each passageway is disposed in a corresponding chamber of the plurality of first chambers.

A first gasket is disposed between the first header assembly and the first end of the shell to substantially prevent leakage of refrigerant from the first header assembly. A second header assembly is detachably fastened to the second end of the shell. The second header assembly includes a second containment body having return chambers. The second containment body includes a second rounded wall portion forming an interior cavity. A flange attaches to the second containment body and fastens the header assembly to the shell. A gasket seals the chambers of the second containment body against the heat exchanger in order to substantially prevent leaks of refrigerant to the atmosphere and seals between the plurality of return chambers when the header assembly is attached to the heat exchanger. At least one divider divides the cavity into a plurality of chambers. The plurality of chambers includes a return chamber for each refrigerant circuit. A second gasket is disposed between the second header and the second end substantially preventing leakage of refrigerant from the second header assembly.

One advantage of the present invention is that the rounded header geometry provides containment of the refrigerant with less material, stronger attachment to the flange and variable chamber sizes via flow restrictor plates to maintain high refrigerant velocities and high operating efficiency.

Another advantage of the present invention is that the header assembly only requires a single gasket between the shell and the header. The reduction in the number of gaskets provides a more reliable seal that has reduced leaks and reduced service costs.

Another advantage of the present invention is the lack of center bolts attaching the header to the shell. Center bolts are not required because of the inherent strength and efficiency of the rounded/dished heads. The removal of the need for center bolts provides a seal that is easier to maintain, provides less stress on the bolts of the flange and provides a greater amount of area in which tubes for heat exchange may be installed.

Another advantage of the present invention is the attachment of the baffles to the header, providing a single piece for installation. Utilizing a single piece header allows for installation that is simpler and less susceptible to leakage.

Another advantage of the present invention is that the inlet piping is attached to the header and extended into the inlet and outlet chambers for more direct flow, increasing the velocity of the refrigerant and efficiency of the operation of the heat exchanger. In addition, the extended nozzles are easier and less costly to fabricate. Diffusers at the end of the extended nozzles facilitate efficient operation and improve performance.

Another advantage of the present invention is that the baffles may be arranged in a plurality of configurations, which can adjust the size of the chambers within the head. Adjustment of the chamber size provides control of the velocity of the refrigerant and residence time of the refrigerant in the header. The control of the velocity and residence time allows the header to be customized to the particular application and/or retrofitted to existing heat exchangers.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

HVAC systems may include refrigerant circuits having a compressor, a condenser, and an evaporator connected in a refrigerant loop. Refrigerant is circulated through the refrigerant loop to the various components. The compressor compresses refrigerant vapor and delivers it to the condenser. The refrigerant vapor delivered by the compressor to the condenser enters into a heat exchange relationship with water or other suitable heat exchange fluid, heating the water while undergoing a phase change to a refrigerant liquid as a result of the heat exchange relationship with the water. The refrigerant leaves the condenser and is delivered to an evaporator. One type of evaporator or cooler is referred to as a chiller heat exchanger, commonly referred to as a direct expansion heat exchanger. The chiller heat exchanger places the liquid refrigerant from the condenser into a heat exchange relationship with a fluid, typically water, and undergoes a phase change to a refrigerant vapor as a result of the heat exchange relationship with the fluid, removing heat from the fluid, typically resulting in a reduction in fluid temperature. The cooled fluid then may be used for cooling applications, including the cooling of buildings. The vapor refrigerant in the chiller heat exchanger exits the chiller heat exchanger and returns to the compressor to complete the cycle. Chiller systems may also include multiple refrigerant circuits having independent refrigerant loops. Refrigerant in the refrigerant loops circulate through one or more compressors, condensers and evaporators, without combining refrigerant streams. Multiple refrigerant circuits may share single components, such as evaporators. When multiple refrigerant loops share a single component, the refrigerant streams remain independent of each other, but exchange heat with the same fluid. In chiller heat exchangers, multiple sets of tubes may be used to maintain independent refrigerant loops. The utilization of a single component in multiple circuit systems allows for increased efficiency of the system and reduction in space required for the chiller system.

Figure 1:
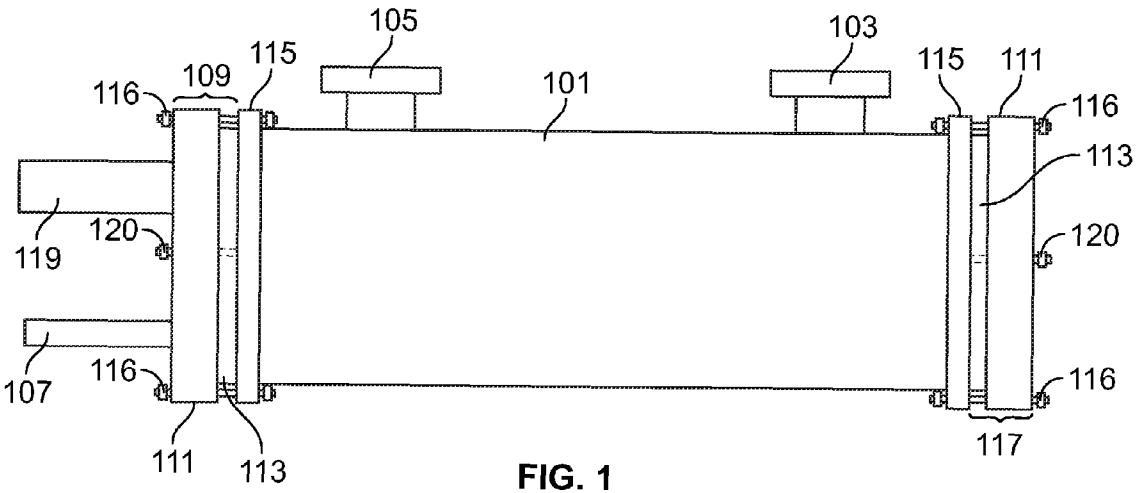
FIG. 1 (Prior Art)
FIG. 1 shows a side view of a known chiller heat exchanger.

FIG. 1 shows a known chiller heat exchanger for use with an HVAC system having flat plate headers 109 and 117. The chiller heat exchanger shown in FIG. 1 is a shell and tube heat exchanger having a shell 101, which receives a fluid, typically water, through shell inlet line 103. The water in the shell 101 enters into a heat exchange relationship with refrigerant passing through tubes arranged within the shell 101. The water then exits the shell 101 through water outlet line 105. Liquid refrigerant, typically from a condenser, is circulated to the chiller heat exchanger through refrigerant inlet line 107. Refrigerant inlet line 107 delivers the liquid refrigerant to the first flat header 109. The first flat header 109 comprises a head plate 111 and a baffle chamber 113. The head plate 111 is a flat, relatively thick plate that provides containment for the refrigerant within the system. A gasket must be placed between the head plate 111 and the baffle chamber 113 in order to reduce leakage. The baffle chamber 113 contains one or more baffles that direct the flow of refrigerant into a first set of tubes 309 (see FIG. 3) that are arranged in the shell 101 and substantially prevents the direct flow of refrigerant between the inlet and outlet. The head plate 111 and the baffle chamber 113 are fastened to a tubesheet 115 of shell 101 by fasteners 116. A second gasket must be placed between the baffle chamber 113 and the tubesheet 115 in order to reduce leakage. The shell 101 includes a tubesheet 115 at each end of the shell 101 and provides openings into which refrigerant may pass and a flange to which the header may be attached. The return end of the shell 101 includes a second header 117. Like the first flat header 109, the second header 117 comprises a head plate 111 and baffle chamber 113. Also like the first flat header 109, the head plate 111 is a flat, relatively thick plate. Also like the first header 109, the second flat header 117 requires at least two gaskets in order to reduce leakage. Center bolts 120 are also shown on the inlet/outlet and return heads. The liquid refrigerant from refrigerant inlet line 107 passes through the first flat header 109, enters the tubes arranged within the shell 101 and travels to the second flat header 117. Heat transfer between the refrigerant and heat transfer fluid takes place within the shell 101 and generally results in a mixed phase refrigerant, i.e., liquid and vaporous refrigerant. The refrigerant in the second flat header 117 then enters a second set of tubes 311 (see FIG. 3), which flow back in a direction toward the first flat header 109. The refrigerant continues to exchange heat with the fluid in the shell 101 and reenters the first flat header 109. The refrigerant then exits the first flat header 109 through outlet line 119 substantially as a vapor. The baffle chamber 113 in each of the first flat header 109 and second flat header 117 may also include an arrangement that provides a number of passes of refrigerant across the shell that is greater than two.

Figure 2:
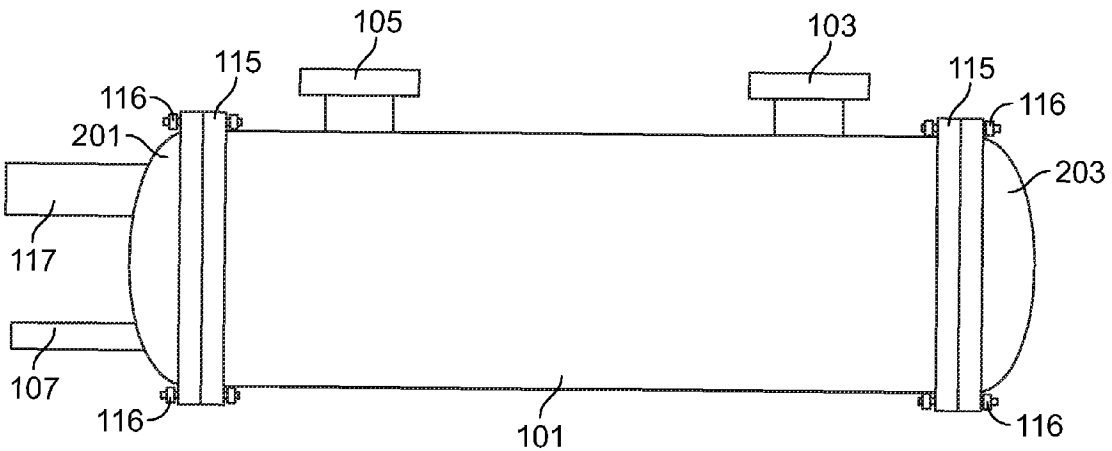
FIG. 2 shows a side view of a chiller heat exchanger according to the present invention.

FIG. 2 shows a chiller heat exchanger according to the present invention. FIG. 2 has substantially the same arrangement of shell 101, shell inlet line 103, water outlet line 105, tubesheet 115, refrigerant inlet line 107 and refrigerant outlet line 119, as shown and described with respect to FIG. 1. However, unlike FIG. 1, FIG. 2 includes a first header 201 and a second header 203 having a curved geometry, without the use of a baffle chamber 113 and with a single gasket between first header 201 and second header 203 and tubesheets 115. The curved or dished heads are inexpensive and may be easily fabricated and eliminate the need for center bolts. The gasket may be fabricated from any suitable sealing device that provides sealing of the first and second headers 201 and 203 against the tubesheets 115. Suitable materials include, but are not limited to neoprene or rubber. First header 201 and second header 203 are attached to shell 101 by fasteners 116. Although FIG. 2 shows bolts fastening the first and second headers 201 and 203 against the tubesheet, any suitable fastening means may be used, including welding, clamping or adhering the first and second headers 201 and 203 to the tubesheet 115. The refrigerant inlet 108 and refrigerant outlet 119 pass through the curved portion of first header 201 and provides refrigerant to and takes refrigerant from the chiller heat exchanger. Although FIG. 2 only shows one refrigerant inlet 107 and one refrigerant outlet 117, the chiller heat exchanger may include multiple inlets and outlets, corresponding to multiple circuits.

Figure 3:
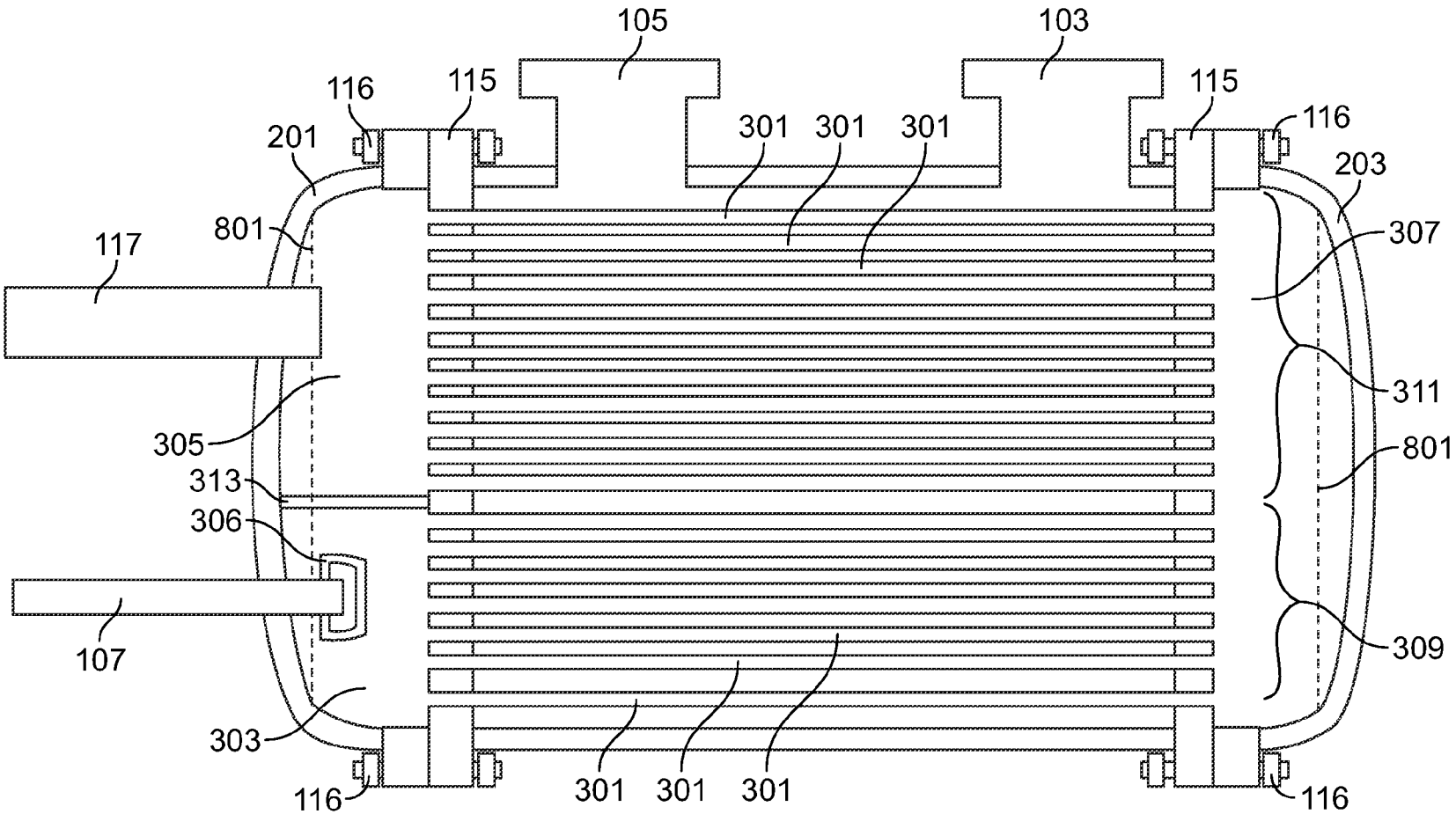
FIG. 3 shows a cutaway view of a chiller heat exchanger according to one embodiment of the present invention.

FIG. 3 shows a cutaway view of the heat exchanger according to the present invention, as shown in FIG. 2. Shell 101 contains a plurality of tubes 301, which fluidly connect inlet chamber 303 and outlet chamber 305 to return chamber 307. The tubes 301 are divided into a first set of tubes 309 and a second set of tubes 311. Inlet chamber 303 receives refrigerant, typically liquid refrigerant, from refrigerant inlet line 107. Refrigerant inlet line 107 includes a refrigerant diffuser 306 that diffuses the flow of refrigerant and distributes the refrigerant across tubes 301 of the first set of tubes 309. Although diffuser 306 has been shown as a plate that directs flow substantially perpendicular to the flow into the chiller heat exchanger, any configuration of diffuser 306 may be used so long as the flow of refrigerant is sufficiently diffused to maintain efficient operation of the chiller heat exchanger. The refrigerant in tubes 301 of the first set of tubes 309 flows from the inlet chamber 303 to the return chamber 307. Also, a flow restrictor plate 801 (see FIG. 8A) may be included to assure high velocity and enhanced performance. The location of the restrictor plate can be adjusted to achieve the desired refrigerant flow rate and achieve improved efficiencies of operation.

As the refrigerant passes through the first set of tubes 309, heat is exchanged between the refrigerant in tubes 301 and fluid present in the shell 101. The fluid, typically water, in the shell flows into shell inlet 103, enters into a heat exchange relationship with the refrigerant in tubes 301, wherein the water is cooled, and exits through water outlet 105. The shell inlet 103 and shell outlet 105 may be positioned in any configuration along the length of the shell 101 that provides efficient operation of the chiller heat exchanger. The cooled water leaving the chiller heat exchanger flows to a heat load, such as a building cooling system. Although the fluid in the shell has been described as including water, any suitable heat exchange fluid may be used within the shell 101, including but not limited to brine or glycol solutions. The heat transfer typically involves heat passing from the water to the refrigerant and resulting in a phase change of the refrigerant from a liquid to a vapor. Refrigerant entering return chamber 307 preferably includes a mixture of vapor and liquid. The refrigerant in return header 307 is distributed across tubes 301 of the second set of tubes 311. The refrigerant from the return chamber 307 flows in tubes 301 to outlet chamber 305. A baffle 313 attached to first header 201 separates the inlet chamber 303 from outlet chamber 305. Like in the first set of tubes 309, the refrigerant exchanges heat with the fluid in the shell 101 and continues to change from a liquid to a vapor. The refrigerant in outlet header 305 is preferably a vapor. The refrigerant in outlet header 305 exits the chiller heat exchanger through outlet line 117. From the chiller heat exchanger refrigerant outlet 117, the refrigerant continues to circulate through the refrigerant loop.

Figure 4B:
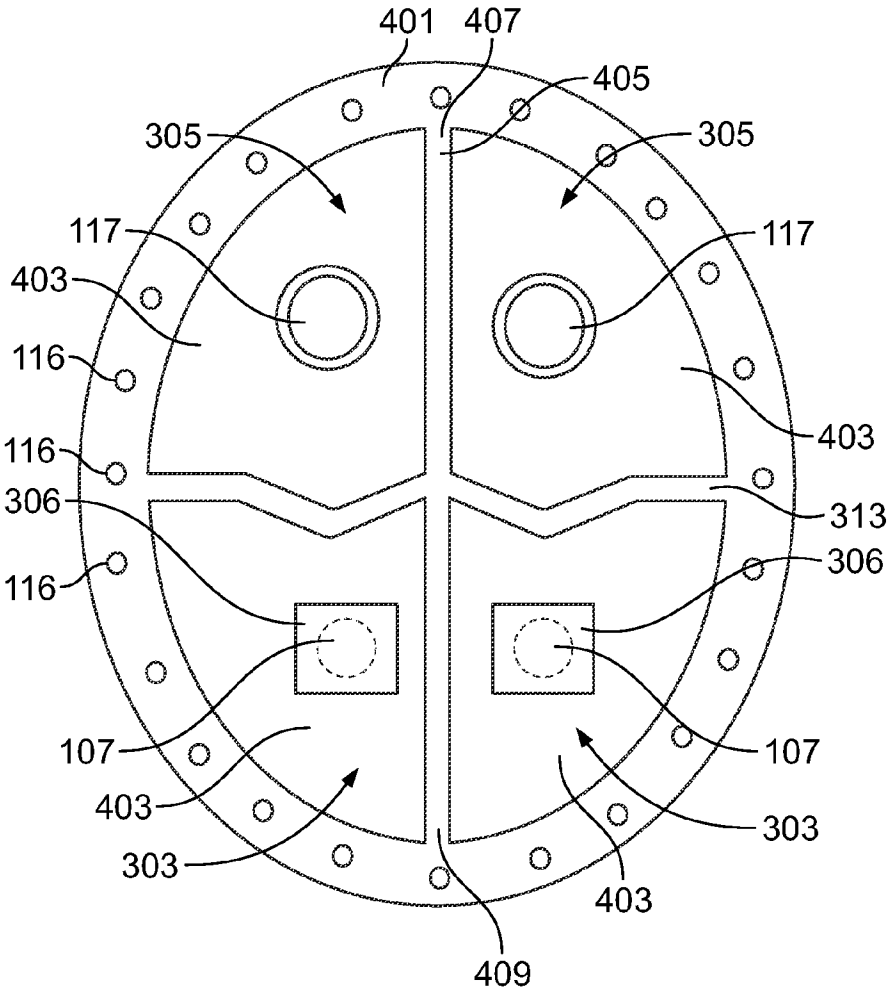
FIG. 4B shows a cutaway front view of an inlet/outlet header according to one embodiment of the present invention.
Figure 4A:
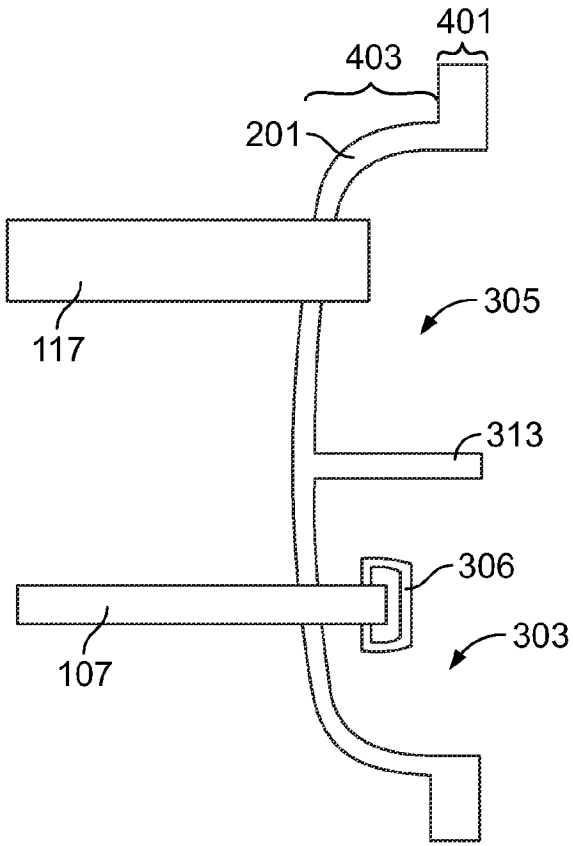
FIG. 4A shows a cutaway side view of an inlet/outlet header according to one embodiment of the present invention.

FIGS. 4A and 4B show cutaway views of first header 201 for attachment to a chiller heat exchanger for chiller systems having two refrigerant circuits. Header 201 shown in FIGS. 4A and 4B includes refrigerant inlet 107, refrigerant outlet 117, diffuser 306, and baffle 313, as shown and described with respect to FIG. 3. FIG. 4A shows a side view cross-section of first header 201. Header 201 includes a flange portion 401 and a rounded wall portion 403. The rounded wall portion 403 defines inlet chamber 303 and outlet chamber 305 when attached to a tubesheet 115 (see FIG. 3). Baffle 313 divides the first header 201 into inlet chamber 303 and outlet chamber 305. FIGS. 4A and 4B show a two refrigerant circuit system wherein one circuit corresponds to one of the refrigerant inlets 107 and one of the refrigerant outlets 117 and a second circuit corresponds to the other refrigerant inlet 107 and refrigerant outlet 117. FIG. 4B shows a cutaway front view of first header 201. FIG. 4B shows two refrigerant inlets 107 and two refrigerant outlets 117. The refrigerant inlets 107 provide refrigerant to inlet chambers 303. Inlet chambers 303 for each of the refrigerant circuits are divided by circuit divider 405. Outlet chambers 305 for each of the refrigerant circuits are divided by circuit divider 405. Circuit divider 405 extends from a first point 407 on the flange portion 401 to a second point 409 on the flange portion 401 and extends circumferentially along the rounded wall portion 403 to form a seal that substantially prevents leakage of refrigerant between the two circuits.

Figure 5B:
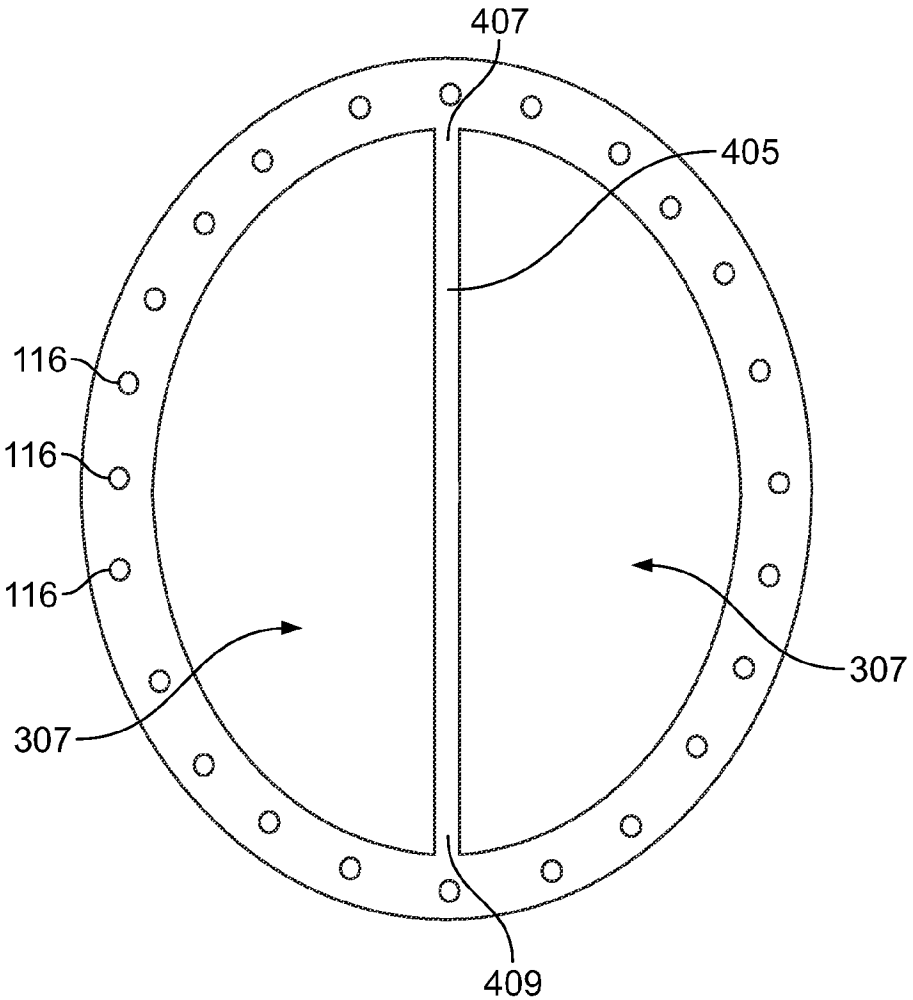
FIG. 5B shows a cutaway front view of a return header according to one embodiment of the present invention.
Figure 5A:
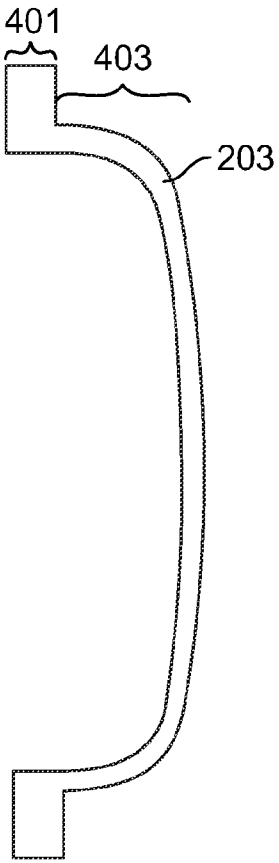
FIG. 5A shows a cutaway side view of a return header according to one embodiment of the present invention.

FIGS. 5A and 5B show cutaway views of second header 203 for attachment to the opposite end of the chiller heat exchanger from the first header 201 by fasteners 116. FIG. 5A shows a side view cross-section of second header 203. Like first header 201, second header 203 includes a flange portion 401 and a rounded wall portion 403. The rounded wall portion 403 in FIGS. 5A and 5B defines return chamber 307 when attached to a tubesheet 115 (see FIG. 3). FIG. 5B shows a cutaway front view of second header 203. FIG. 5B shows two return chambers 307, each corresponding to one of the two refrigerant circuits. Return chambers 307 for each of the refrigerant circuits are divided by circuit divider 405. Circuit divider 405 extends from a first point 407 on the flange portion 401 to a second point 409 on the flange portion 401 and extends circumferentially along the rounded wall portion 403 to form a seal that substantially prevents leakage of refrigerant between the two circuits.

Figure 6:
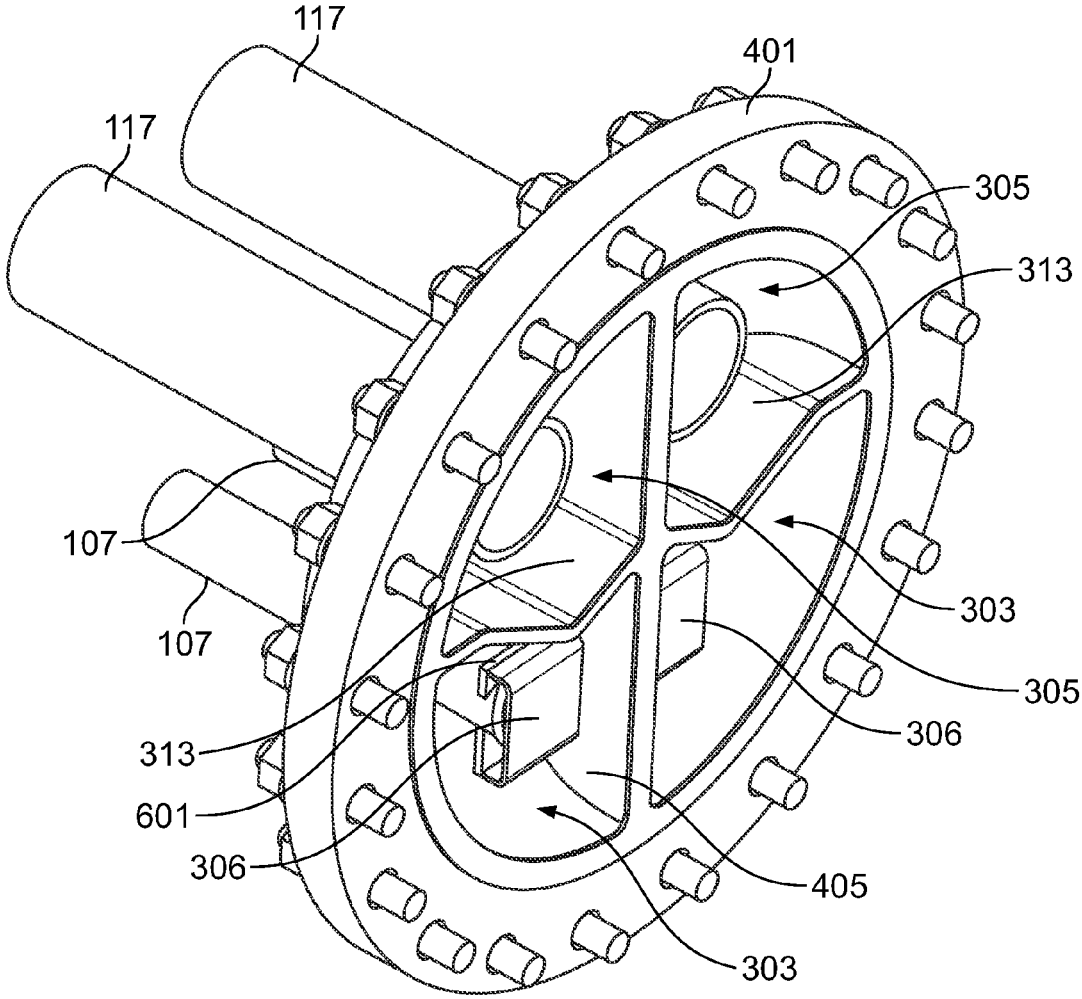
FIG. 6 shows a perspective view of an inlet/outlet header according to one embodiment of the present invention.

FIG. 6 shows a perspective view of first header 201 according to the present invention. FIG. 6 includes refrigerant inlets 107, refrigerant outlets 117, flange portion 401, diffuser 306, baffle 313, and circuit divider 405, as shown and described in FIGS. 3, 4A and 4B. The interior spaces of inlet chamber 303 and outlet chamber 305 are shown. Inlet chambers 303 and outlet chambers 305 are defined by the surfaces of the first header 201, rounded wall portion 403, the circuit divider 405, baffle 313 and tubesheet 115 (see FIG. 3) when first header 201 is attached to tubesheet 115 by fasteners 116. A gasket 601 is disposed adjacent to the flange portion 401, circuit divider 405 and baffle 313 in order to provide a seal when the first header is fastened to tubesheet 115. The refrigerant inlets 107 and refrigerant outlets 117 extend into the interior spaces of inlets chamber 303 and outlet chambers 305. The extension of the refrigerant inlets 107 and refrigerant outlets 117 permit refrigerant to flow into or from the tubes 301 with a desirable flow profile and maintain efficient operation of the heat exchanger.

Figure 7:
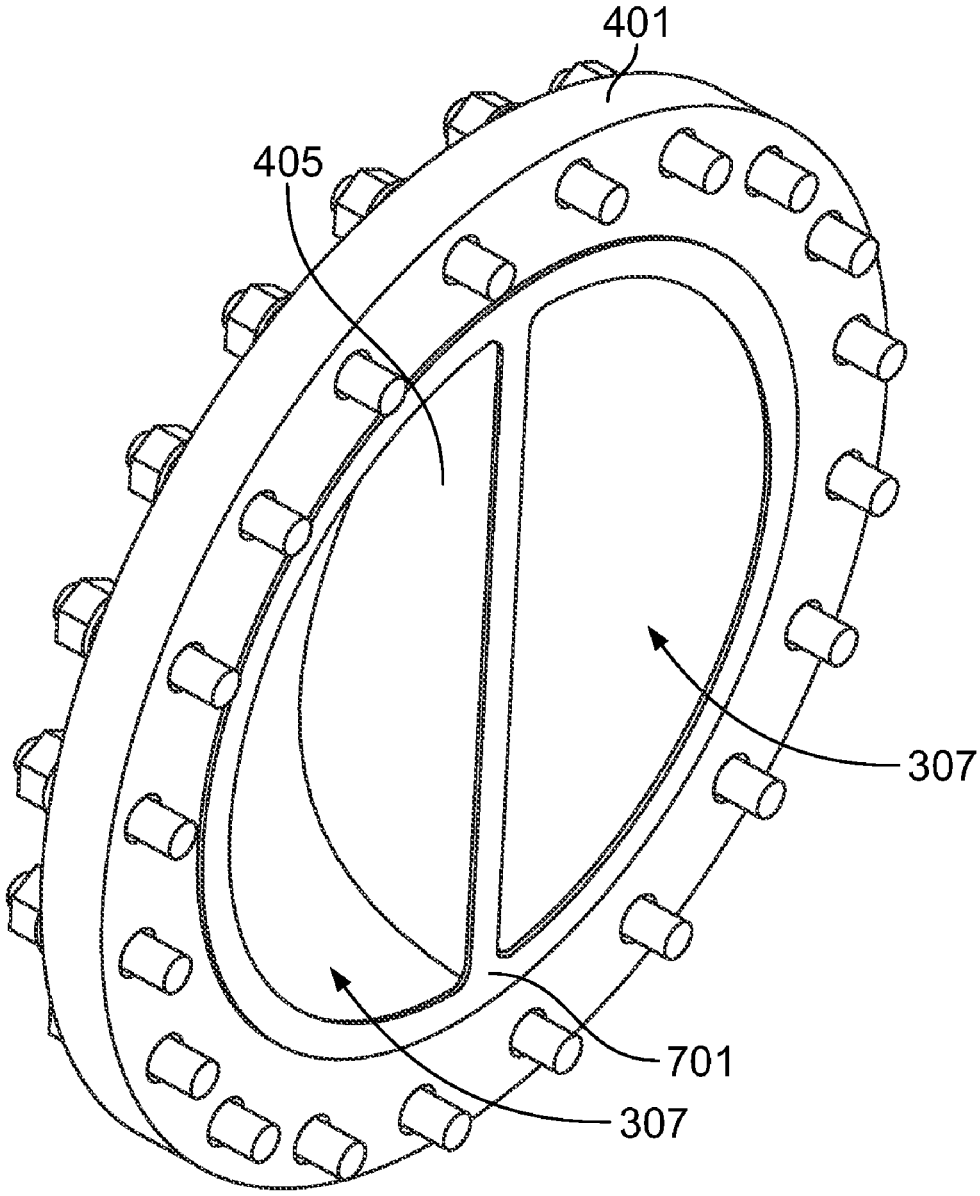
FIG. 7 shows a perspective view of a return header according to one embodiment of the present invention.

FIG. 7 shows a perspective view of second header 203 according to the present invention. FIG. 7 includes flange portion 401, and circuit divider 405, as shown and described in FIGS. 3, 5A and 5B. The interior space of return chamber 307 is shown. Return chamber 307 is formed when second header 203 is fastened to tubesheet 115 (see FIG. 3) by fasteners 116. The return chamber is defined by the rounded wall portion 403, circuit divider 405 and tubesheet 115 when the second header 203 is attached to tubesheet 115. The geometry of return chamber 307, including the rounded wall portion 403, provides efficient flow of refrigerant through the heat exchanger wherein the refrigerant maintains a high velocity.

Figure 8B:
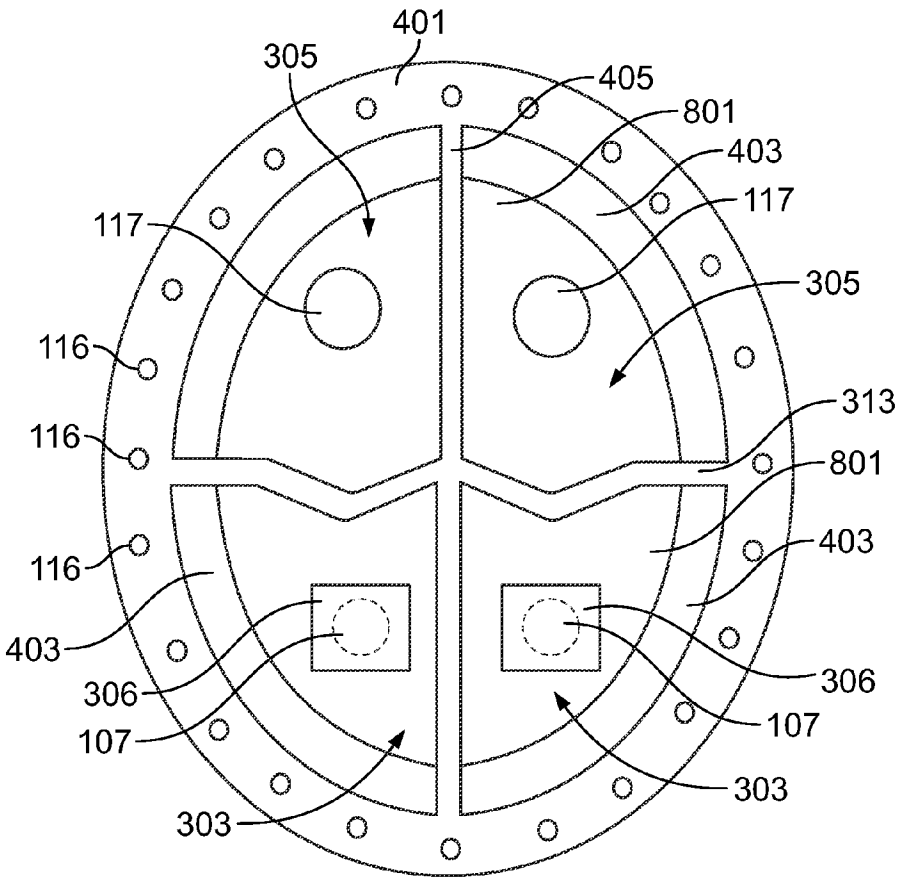
FIG. 8B shows a cutaway front view of an inlet/outlet header according to an alternate embodiment of the present invention.
Figure 8A:
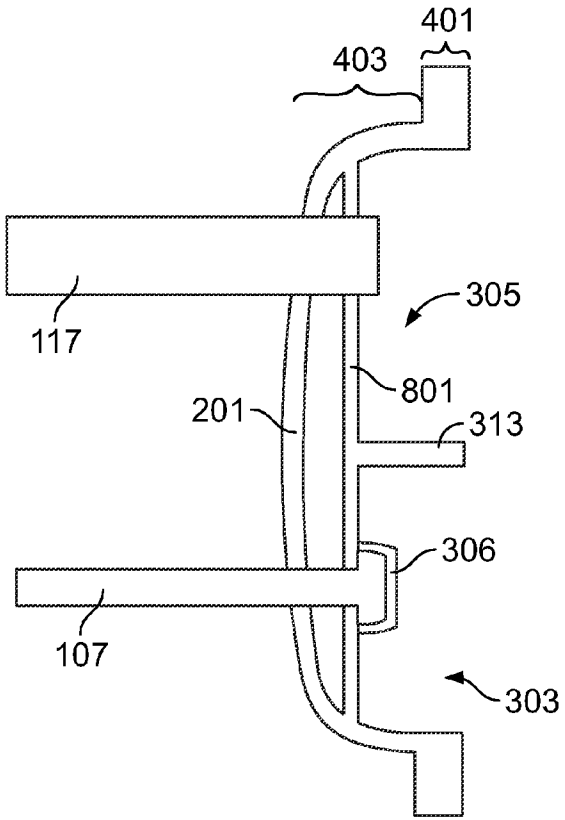
FIG. 8A shows a cutaway side view of an inlet/outlet header according to an alternate embodiment of the present invention.

FIGS. 8A and 8B show a cutaway view of an alternate embodiment according to the present invention. FIG. 8A shows a cutaway side view of first header 201 having inlet chamber 303, and outlet chamber 305 as shown and described with respect to FIG. 4A. However, FIG. 8A further includes a restrictor plate 801 that reduces the volume of the chambers 303 and 305. Restrictor plate 801 is preferably attached to the rounded wall portion 403 and sealed to provide a predetermined volume within the chambers. Although FIG. 8A shows the restrictor plate 801 arranged vertically within the header across refrigerant inlet 107 and refrigerant outlet 117, restrictor plate 801 may be arranged in any suitable configuration that provides control of the volume within the inlet and outlet chambers 303 and 305. Restrictor plate 801 provides additional control of the velocity of the refrigerant through the chiller heat exchanger. In addition, the restrictor plate 801 provides the refrigerant inlet 107 and refrigerant outlet 117 with greater stability from the additional attachment point to the first header 201. The restrictor plate 801 also provides a surface to which the diffuser 306 may be attached, providing for easier assembly of the first header 201. FIG. 8B shows a cutaway front view of first header 201 having inlet chamber 303, and outlet chamber 305 as shown and described with respect to FIG. 4B. FIG. 8B includes a restrictor plate 801 reducing the volume of the chambers 303 and 305. As shown in FIG. 8B, the restrictor plate 801 is circumferentially attached to wall portion 403. Although the restrictor plate is shown as a substantially flat plate, the restrictor plate may be any geometry that reduces the volume in inlet and outlet chambers 303 and 305. For example, the restrictor plate 801 may also be a curved portion having a smaller radius of curvature than the first and second headers 201 and 203, forming a chamber including at least one curved surface. Further, the restrictor plates 801 may be present in any combination of chambers, including one or more of the inlet chamber 303, outlet chamber 305, and return chamber 307. In addition, refrigerant inlets 107 and refrigerant outlets 117 extend through the restrictor plate 801 and are likewise attached to restrictor plate 801. The circuit divider 405 and baffle 313 are attached to and extend from the restrictor plate 801 to an extent that allows a seal when first header 201 is attached to a tubesheet 115 (see FIG. 3). Although FIGS. 8A and 8B show the baffle and circuit divider 405 extending from the restrictor plate 801, the baffle 313 and circuit divider may also extend through the restrictor plate 801 to the rounded wall portion 403.

Figure 9B:
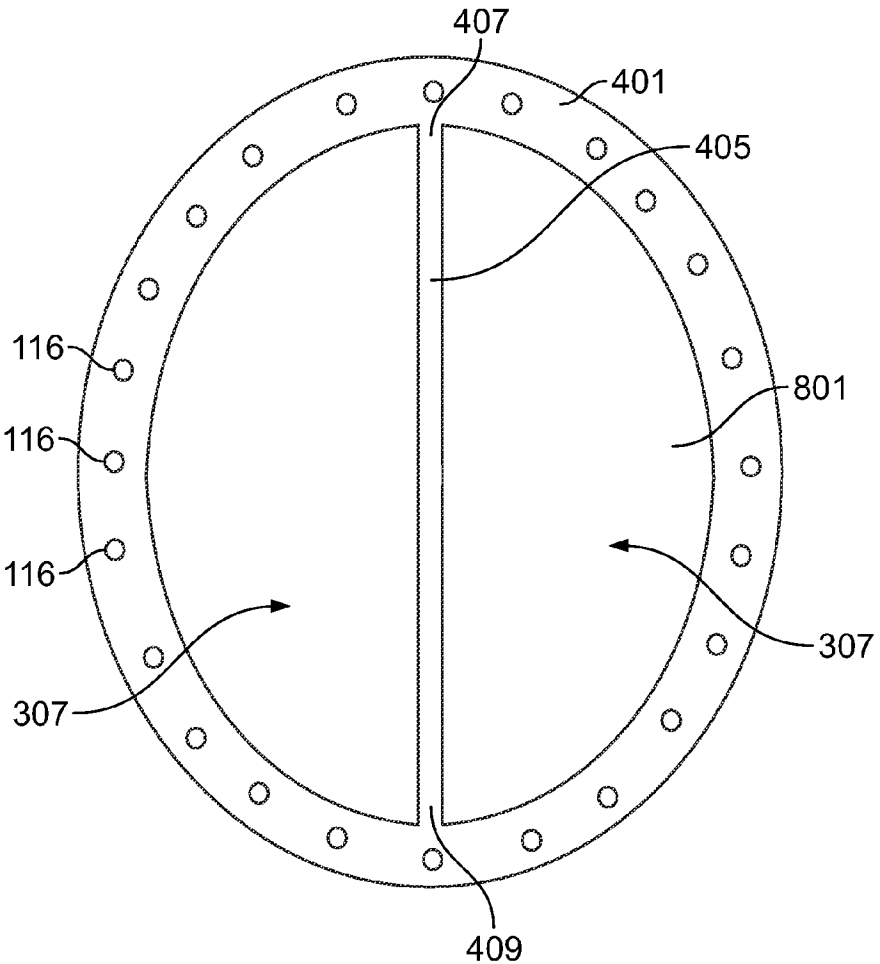
FIG. 9B shows a cutaway front view of a return header according to an alternate embodiment of the present invention.
Figure 9A:
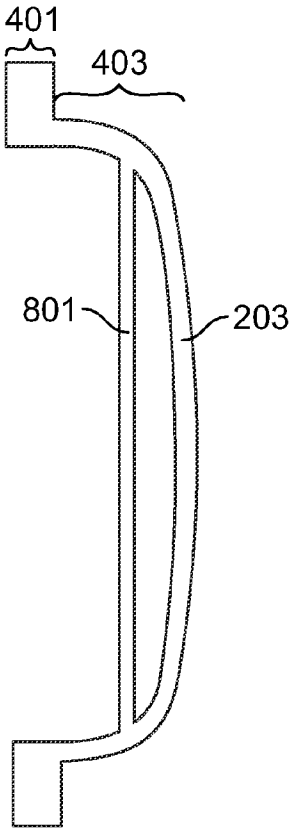
FIG. 9A shows a cutaway side view of a return header according to an alternate embodiment of the present invention.

FIGS. 9A and 9B show second header 203 according to an alternate embodiment of the invention. FIG. 9A shows a cutaway side view of second header 203 having return chamber 307, as shown and described with respect to FIG. 5A. FIG. 9A further includes a restrictor plate 801 that reduces the volume of the return chamber 307. FIG. 9B shows a cutaway front view of second header 203 having return chamber 307, as shown and described with respect to FIG. 5B. The circuit divider 405 shown in FIGS. 9A and 9B is attached to and extends perpendicularly from the restrictor plate 801 to an extent that allows a seal when second header 203 is attached to a tubesheet 115 (see FIG. 3).

Figure 10:
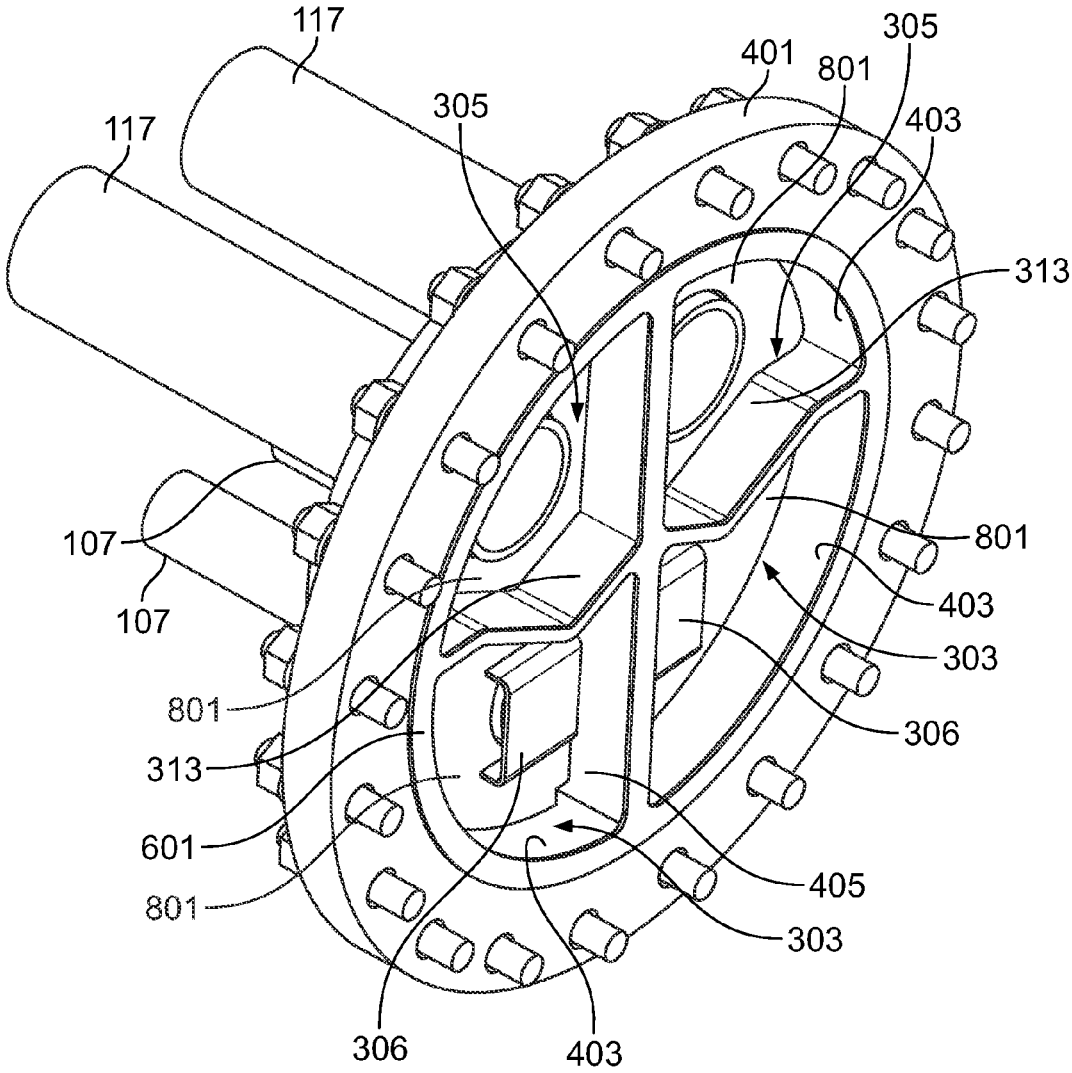
FIG. 10 shows a perspective view of an inlet/outlet header according to an alternate embodiment of the present invention.

FIG. 10 shows a perspective view of first header 201 according to an alternate embodiment of the invention. FIG. 10 shows the arrangement of FIG. 6 further comprising restrictor plate 801. As shown and describe with respect to FIGS. 8A and 8B, restrictor plate 801 is circumferentially attached to the wall portion 403, reducing the volume of inlet chambers 303 and outlet chambers 305 when the first header 202 is attached to tubesheet 115. The interior spaces of inlet chamber 303 and outlet chamber 305 are shown. Inlet chambers 303 and outlet chambers 305 are defined by the surfaces of the first header 201, rounded wall portion 403, circuit divider 405, baffle 313, tubesheet 115 (see FIG. 3) and restrictor plate 801 when first header 201 is attached to tubesheet 115 by fasteners 116. Like shown in FIG. 6, gasket 601 is disposed adjacent to the flange portion 401, circuit divider 405 and baffle 313 in order to provide a seal when the first header is fastened to tubesheet 115. The refrigerant inlets 107 and refrigerant outlets 117 extend into the interior spaces of inlet chambers 303 and outlet chambers 305 and are attached to the restrictor plate 801. The extension of the refrigerant inlets 107 and refrigerant outlets 117 permit refrigerant to flow into the tubes 301 with a desirable flow profile and maintain efficient operation of the heat exchanger.

Figure 11:
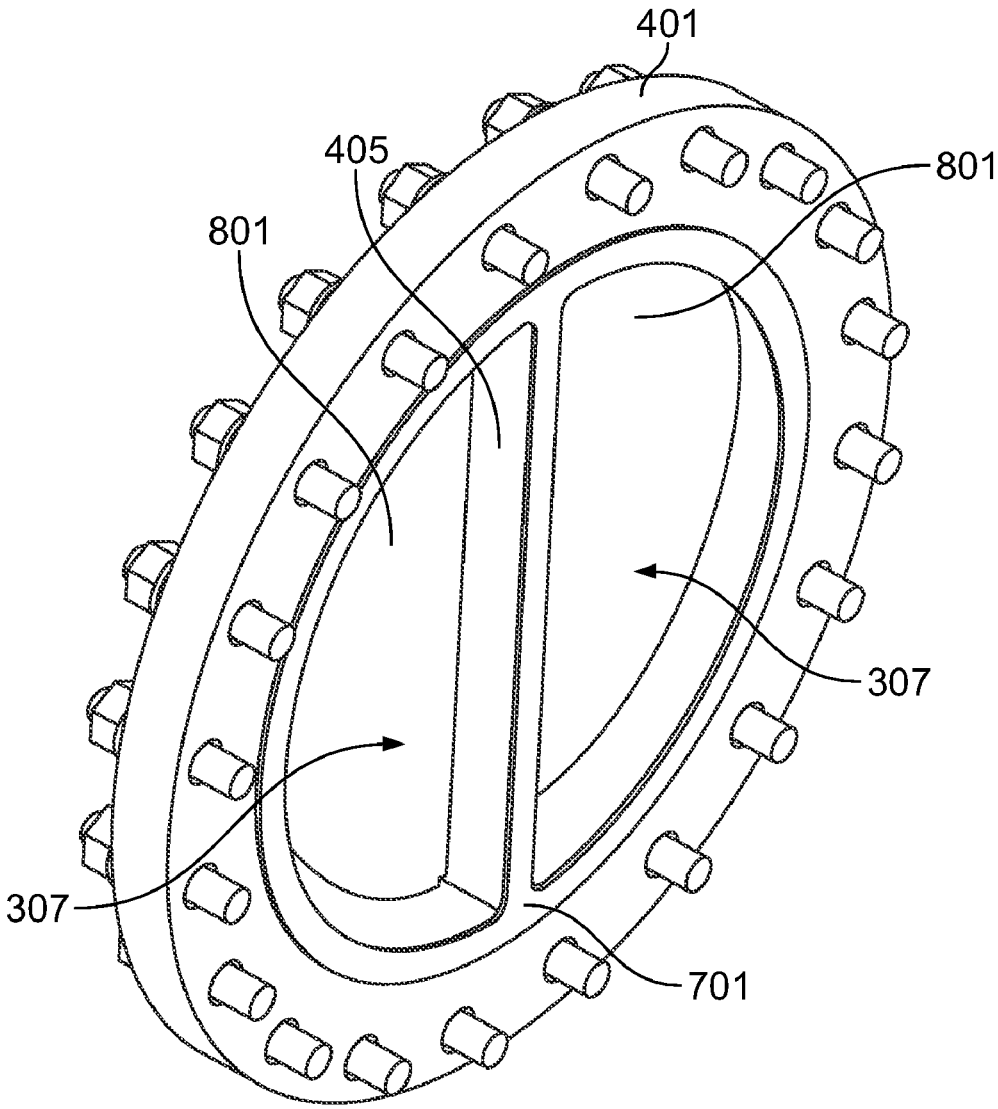
FIG. 11 shows a perspective view of a return header according to an alternate embodiment of the present invention.

FIG. 11 shows a perspective view of second header 203 according to an alternate embodiment of the invention. FIG. 11 shows the arrangement of FIG. 7 further comprising restrictor plate 801. As shown and describe with respect to FIGS. 9A and 9B, restrictor plate 801 is circumferentially attached to the wall portion 403, reducing the volume of return chamber 307 when the first header 202 is attached to tubesheet 115. The interior space of return chamber 307 is shown. Return chamber 307 is formed when second header 203 is fastened to tubesheet 115 (see FIG. 3) by fasteners 116. The return chamber defined by the rounded wall portion 403, circuit divider 405, tubesheet 115 and restrictor plate 801 when the second header 203 is attached to tubesheet 115. The geometry of return chamber 307, including the rounded wall portion 403, provides efficient flow of refrigerant through the heat exchanger wherein the refrigerant maintains a high velocity.

Although the invention has been shown and described with respect to two refrigerant circuits, any number of refrigerant circuits may be used. For example, two circuit dividers 405 may be attached to the rounded wall portion 403 to accommodate three circuits. Likewise, although the invention has been shown and described with respect to a two-pass system, baffles 313 and tubes 301 may be arranged into three or more passes.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A header assembly for a heat exchanger comprising:

a containment body, the containment body comprising a rounded wall portion forming an interior cavity;

a flange portion attached to the containment body and being configured to fasten the header assembly to the heat exchanger;

a plurality of refrigerant passageways, each passageway extending through an opening in the containment body and into the interior cavity;

at least one baffle attached to the rounded wall portion, the baffle being configured and disposed to divide the interior cavity into a plurality of sub-cavities;

at least one divider attached to the containment body, the at least one divider being configured and disposed to divide the sub-cavities into a plurality of chambers; and wherein the plurality of passageways includes an inlet connection and an outlet connection for a plurality of refrigerant circuits, and each passageway is disposed in a corresponding chamber of the plurality of chambers.

2. The header assembly of claim 1, wherein the baffles are adapted to deliver refrigerant to tubes of the heat exchanger when the header is fastened to the heat exchanger.

3. The header assembly of claim 1, wherein the plurality of chambers includes an inlet chamber and an outlet chamber for each refrigerant circuit.

4. The header assembly of claim 3, wherein the header assembly includes two inlet chambers and two outlet chambers, wherein the header is capable of receiving refrigerant from two refrigerant circuits.

5. The header assembly of claim 3, wherein the header assembly includes at least three inlet chambers and at least three outlet chambers, wherein the header is capable of receiving refrigerant from at least three refrigerant circuits.

6. The header assembly of claim 1, wherein the header assembly further includes a restrictor plate attached to the containment body and disposed within at least one of the plurality of chambers arranged to reduce the effective volume of the at least one of the plurality of chambers.

7. The header assembly of claim 1, wherein the header assembly further includes a gasket arranged and disposed to seal the chambers of the containment body against the heat exchanger in order to substantially prevent leaks of refrigerant to the atmosphere and between the plurality of chambers when the header assembly is attached to a heat exchanger.

8. The header assembly of claim 1, wherein the inlet connection includes a diffuser to diffuse the flow of refrigerant into the heat exchanger.

9. A header assembly for attachment to a heat exchanger comprising:

a containment body, the containment body comprising a rounded wall portion forming an interior cavity;

a flange portion attached to the containment body and being configured to fasten the header assembly to the heat exchanger;

a gasket arranged and disposed to seal the chambers of the containment body against the heat exchanger in order to substantially prevent leaks of refrigerant to the atmosphere and between the plurality of chambers when the header assembly is attached to the heat exchanger;

at least one divider attached to the containment body, the at least one divider being configured and disposed to divide the cavities into a plurality of chambers, the plurality of chambers corresponding to a plurality of refrigerant circuits; and wherein the plurality of chambers includes a return chamber for each refrigerant circuit.

10. The header assembly of claim 9, wherein the header assembly includes two return chambers, corresponding to two refrigerant circuits.

11. The header assembly of claim 9, wherein the header assembly includes return chambers, corresponding to three refrigerant circuits.

12. The header assembly of claim 9, wherein the header assembly further includes a restrictor plate attached to the containment body and disposed within at least one of the plurality of chambers arranged to reduce the effective volume of the at least one of the plurality of chambers.

13. A heat exchanger comprising:

a shell for containing heat transfer fluid having a first end and a second end;

a plurality of tubes for containing refrigerant arranged and disposed within the shell, the plurality of tubes including a first set of tubes and a second set of tubes, a first header assembly detachably fastened to the first end, the first header assembly comprising:

a first containment body, the first containment body comprising a rounded wall portion forming an interior cavity;

a first flange portion attached to the first containment body and being configured to fasten the header assembly to the heat exchanger;

a plurality of refrigerant passageways, each passageway extending through an opening in the first containment body and into the interior cavity;

at least one baffle attached to the rounded wall portion, the baffle being configured and disposed to divide the interior cavity of the first containment body into a plurality of sub-cavities;

at least one divider attached to the first containment body, the at least one divider being configured and disposed to divide the sub-cavities of the first containment body into a plurality of chambers; and wherein the plurality of passageways includes an inlet connection and an outlet connection for a plurality of refrigerant circuits, and each passageway is disposed in a corresponding chamber of the plurality of chambers of the first containment body;

a first gasket disposed between the first header and the first end substantially preventing leakage of refrigerant from the first header assembly;

a second header assembly detachably fastened to the second end, the second header assembly comprising:

a second containment body, the second containment body comprising a rounded wall portion forming an interior cavity;

a second flange portion attached to the second containment body and being configured to fasten the header assembly to the heat exchanger;

at least one divider attached to the second containment body, the at least one divider being configured and disposed to divide the cavities of the second containment body into a plurality of chambers; and wherein the plurality of chambers of the second containment body includes a return chamber for each refrigerant circuit; and a second gasket disposed between the second header and the second end substantially preventing leakage of refrigerant from the second header assembly.

14. The heat exchanger of claim 12, wherein the first header assembly and second header assembly further includes one or more restrictor plates attached to one or more of the first containment body and the second containment body and disposed within at least one of the plurality of chambers arranged to reduce the effective volume of the at least one of the plurality of chambers.

15. The heat exchanger of claim 12, further including a gasket disposed between the first header assembly and the first end and a gasket disposed between the second header assembly and the second end to seal the chambers of the first containment body and the second containment body against the heat exchanger in order to substantially prevent leaks of refrigerant to the atmosphere and between the plurality of chambers.

16. The heat exchanger of claim 12, wherein the inlet connection includes a diffuser to diffuse the flow of refrigerant into the heat exchanger.

* * * * *